US008557486B2

(12) United States Patent
Ishida et al.

(10) Patent No.: US 8,557,486 B2
(45) Date of Patent: Oct. 15, 2013

(54) ORGANIC PHOTORECEPTOR, MANUFACTURING METHOD OF ORGANIC PHOTORECEPTOR, AND IMAGE FORMING APPARATUS

(75) Inventors: Takeshi Ishida, Tokyo (JP); Hirofumi Hayata, Tokyo (JP); Masahiko Kurachi, Tokyo (JP); Toshiyuki Fujita, Tokyo (JP); Seisuke Maeda, Tokyo (JP); Seijiro Takahashi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 584 days.

(21) Appl. No.: 12/620,935

(22) Filed: Nov. 18, 2009

(65) Prior Publication Data

US 2010/0129115 A1 May 27, 2010

(30) Foreign Application Priority Data

Nov. 26, 2008 (JP) ..... 2008-300640

(51) Int. Cl.
*G03G 5/147* (2006.01)

(52) U.S. Cl.
USPC ..... 430/66; 430/67; 430/59.6

(58) Field of Classification Search
USPC ..... 430/66, 67, 59.6, 132
See application file for complete search history.

(56) References Cited

U.S. PATENT DOCUMENTS

| | | | | |
|---|---|---|---|---|
| 4,148,637 | A * | 4/1979 | Kubota et al. | 430/66 |
| 5,391,449 | A * | 2/1995 | Maruyama et al. | 430/66 |
| 5,422,210 | A * | 6/1995 | Maruyama et al. | 430/58.4 |
| 5,747,207 | A * | 5/1998 | Mashimo | 430/66 |
| 6,664,014 | B1 * | 12/2003 | Kikuchi et al. | 430/66 |
| 6,835,512 | B2 * | 12/2004 | Morikawa et al. | 430/58.05 |
| 7,122,253 | B2 * | 10/2006 | Yamaguchi et al. | 428/447 |
| 7,416,823 | B2 * | 8/2008 | Yanagawa et al. | 430/58.7 |
| 7,764,906 | B2 * | 7/2010 | Niimi | 399/159 |
| 7,951,516 | B2 * | 5/2011 | Inagaki et al. | 430/59.6 |
| 2002/0197485 | A1 * | 12/2002 | Nishikawa et al. | 428/423.1 |
| 2004/0013442 | A1 * | 1/2004 | Suzuki et al. | 399/92 |
| 2004/0157972 | A1 * | 8/2004 | Yamaguchi et al. | 524/430 |

FOREIGN PATENT DOCUMENTS

| | | | |
|---|---|---|---|
| JP | H06118681 | 4/1994 | |
| JP | 11095474 | 4/1999 | |
| JP | H11095473 | 4/1999 | |
| JP | 2005345791 A * | 12/2005 | G03G 5/147 |

OTHER PUBLICATIONS

English language machine translation of JP 2005-345791 (Dec. 2005).*

* cited by examiner

*Primary Examiner* — Christopher Rodee
(74) *Attorney, Agent, or Firm* — Lucas & Mercanti, LLP

(57) ABSTRACT

An organic photoreceptor having a photosensitive layer, an electric conductive support, and a protective layer is disclosed, in which the protective layer comprises a composition produced by reacting tin oxide particles an acryloyl or methacryloyl group on their surface with a compound having an acryloyl or methacryloyl group. A production method of the same, an image forming apparatus and a process cartridge using the same are also disclosed.

8 Claims, 2 Drawing Sheets

ORGANIC PHOTORECEPTOR, MANUFACTURING METHOD OF ORGANIC PHOTORECEPTOR, AND IMAGE FORMING APPARATUS

This application is based on Japanese Patent Application No. 2008-300640 filed on Nov. 26, 2008, in Japanese Patent Office, the entire content of which is hereby incorporated by reference.

FIELD OF THE INVENTION

The present invention directs to an organic photoreceptor used in the field of an image forming apparatus, a manufacturing method of the organic photoreceptor, an image forming apparatus employing the organic photoreceptor, and a process cartridge and an image forming apparatus using this organic photoreceptor.

BACKGROUND

An organic photoreceptor containing an organic photoconductive material is most widely employed in the electrophotography. While the organic photoreceptor has such advantages that it is easy to develop materials corresponding to various exposing light source from visible to infrared light, materials without environmental contamination can be selected, and manufacturing cost is low, in comparison with the other photoreceptor, there is a problem that mechanical strength is weak and it is liable to generate deterioration or damage on a surface of the photoreceptor during a plenty sheets of copying or printing.

It has been demanded to reduce an abrasion due to scraping by cleaning blade etc., so as to improve the durability of the organic photoreceptor. For this purpose technology to provide a protecting layer with high mechanical strength on the photoreceptor has been tried. For example, the patent document No. 1 reports that colloidal silica containing hardenable siloxane resin is used for the protective layer of the photoreceptor. The colloidal silica containing hardenable siloxane resin has high moisture absorbing characteristics both in hardenable resin having siloxane bond (Si—O—Si bond) and colloidal silica, and therefore, electric resistivity of the protective layer is liable to lower and causing image blur or image flow.

The other patent documents Nos. 2 and 3 report a protective layer is composed of hardenable resin obtained by reacting a metal oxide having a polymerizable unsaturated group with an organic compound having a reactive group capable of forming chemical bonding with the polymerizable unsaturated group, and it is successful in obtaining anti-abrasion property compatible to amorphous silicon. However, the problems of image blur or image flow under the condition of high temperature and high humidity is not dissolved sufficiently, and compatibility to the hardness can not be accomplished sufficiently.

Patent document No. 1: JP-A H06-118681
Patent document No. 2: JP-A H11-095473
Patent document No. 3: JP-A H11-095474

SUMMARY OF THE INVENTION

The object of this invention is to dissolve the above mentioned problems, so as to improve an anti-abrasion property of the photoreceptor up to the same level as an amorphous silicone photoreceptor, to improve the image blur and image flow problem liable to generate in high temperature and high moisture condition, and to provide a high durable organic photoreceptor capable of obtaining a high quality electrophotographic image. The other object is to provide an image forming apparatus and process cartridge both employing the organic photoreceptor.

A protective layer of the organic photoreceptor has been studied, and anti-abrasion property and image blur and image flow problem in the high temperature and high moisture condition are found to dissolve, by that the protective layer is composed of a reaction product of tin oxide particles having an acryloyl or methacryloyl group on their surface with a polymerizable compound having a methacryloyl group.

The polymerizable compound having a methacryloyl group is less reactive to give less sufficient hardness than a polymerizable compound having an acryloyl group in general. However it has been found that high reactivity is obtained and sufficient layer strength can be obtained by employing a polymerizable compound having plural methacryloyl groups in a molecule. It has been found that sufficient hardness can be obtained when the condition Ac/M is not less than 0.005.

A methacryloyl function group density Ac/M is defined as a ratio of a number of the methacryloyl groups Ac to a molecular weight M of the polymerizable compound having a methacryloyl group.

The tin oxide particles are optimally employed because of good UV ray transparency as well as sufficient layer strength.

The photoreceptor of this invention comprises a photosensitive layer, provided on an electric conductive support, and a protective layer, wherein the protective layer comprises a composition obtained by reacting tin oxide particles having an acryloyl or methacryloyl group on their surface with a polymerizable compound having a methacryloyl group, and Ac/M being not less than 0.005, wherein Ac is a number of the methacryloyl groups and M is a molecular weight of the polymerizable compound having a methacryloyl group.

DESCRIPTION OF THE INVENTION

Figure 1:
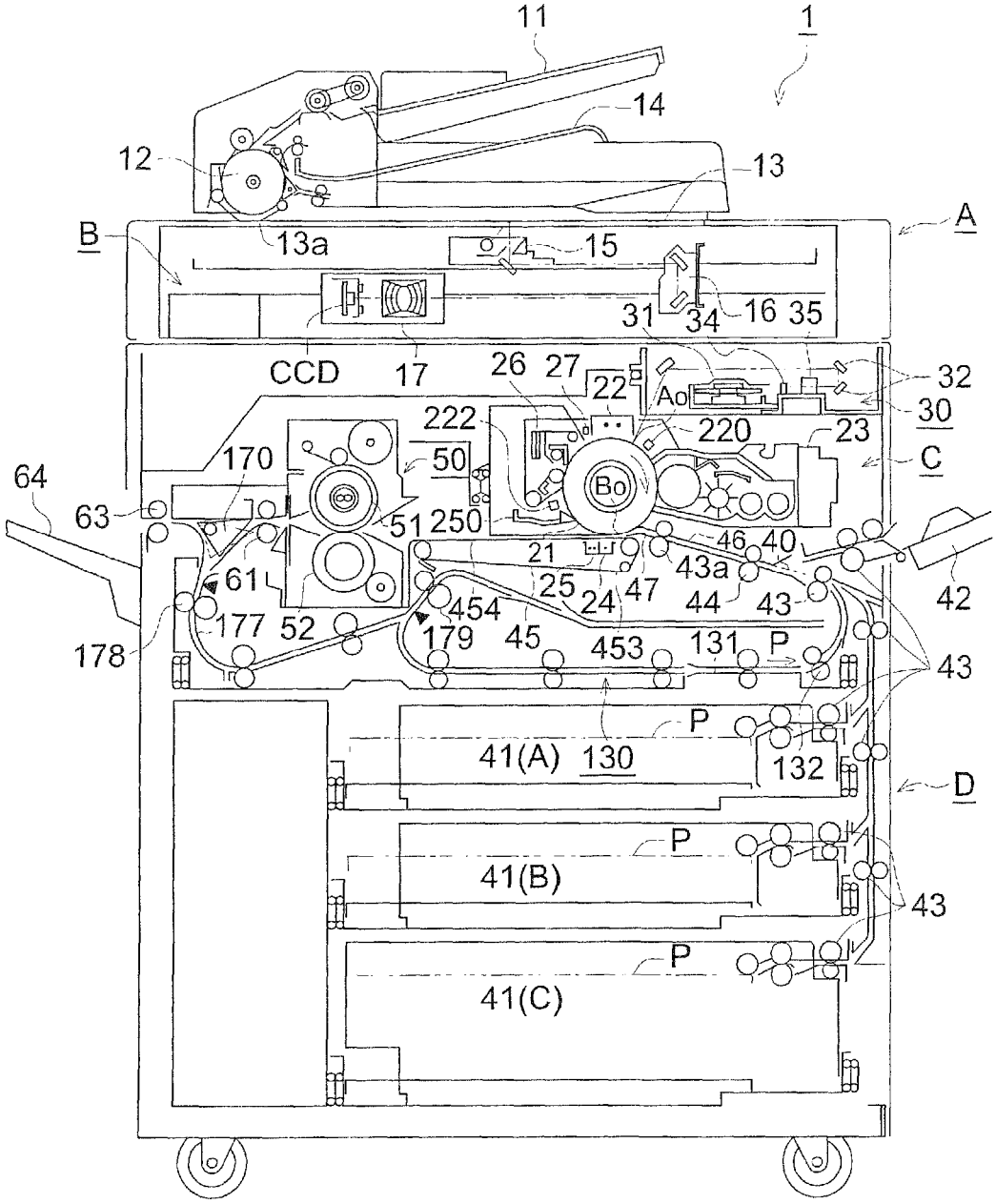
FIG. 1: A schematic view of an image forming apparatus in which the organic photoreceptor is applied.

According to this invention, mechanical strength of the surface of the photoreceptor against rubbing or abrasion is remarkably improved, and surface scratch on the surface of the photoreceptor and abrasion wastage are improved, and further the image blur problem at high temperature and high moisture is remarkably improved.

The tin oxide particles having an acryloyl or methacryloyl group on their surface may be produced by surface treating tin oxide particles with a compound having an acryloyl or methacryloyl group.

The compound having an acryloyl or methacryloyl group includes those represented by the Formula (1), Formula (1)

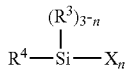

wherein $R^3$ is an alkyl having carbon atoms of from 1 to 10 or an aralkyl having carbon atoms of from 6 to 10, $R^4$ is an organic group having a reactive acryloyl or methacryloyl group, X is a halogen atom, an alkoxy, acyloxy, aminooxy or phenoxy group, n is an integer of from 1 to 3.

Herein $R^3$ is preferably a hydrogen atom, or a methyl or ethyl group.

X is preferably a halogen atom or an alkoxy group.

The protective layer is preferably formed by photo-polymerization or thermal-polymerization of the tin oxide particles having an acryloyl or methacryloyl group with the polymerizable compound having a methacryloyl group.

Ac/M is preferably not less than 0.005 and not more than 0.05.

The photoreceptor can be produced by a method comprising steps of;

forming the photosensitive layer on the support, and forming the protective layer thereon, wherein the protective layer is formed by reacting a polymerizable compound having a methacryloyl group, Ac/M ratio of not more less 0.005 with tin oxide particles surface treated with a silane compound represented by Formula (1), wherein Ac is a number of the methacryloyl groups and M is a molecular weight of the polymerizable compound having a methacryloyl group, Formula (1)

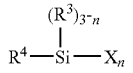

wherein $R^3$ is an alkyl having carbon atoms of from 1 to 10 or an aralkyl having carbon atoms of from 6 to 10, $R^4$ is an organic group having a reactive acryloyl or methacryloyl group, X is a halogen atom, an alkoxy, acyloxy, aminooxy or phenoxy group, n is an integer of from 1 to 3.

A number average particle diameter of the tin oxide particles is preferably 1-300 nm.

The protective layer may be formed by steps of;

applying a protective layer coating composition comprising a tin oxide particles having an acryloyl or methacryloyl group, and a polymerizable compound having a methacryloyl group and Ac/M being not less than 0.005, wherein Ac is a number of the methacryloyl groups and M is a molecular weight of the polymerizable compound having a methacryloyl group, and exposing actinic ray to or heating the coated composition to react the tin oxide particles having a reactive organic group with the polymerizable compound having a methacryloyl group.

The photoreceptor is preferably employed in an image forming apparatus comprising a charging unit, an imagewise exposing unit and a developing unit arranged around the photoreceptor.

It is described that a layer having higher hardness can be obtained by employing high molecular weight oligomer having a molecular weight of more than 1,000 in place of acryl monomer in a layer produced by a reactive tin oxide with light hardenable acryl resin in the Examples of JP-A H11-095473 and JP-A H11-095474, referred above. However problems of image blur or image flow are not dissolved.

A layer having higher hardness can be obtained by employing tin oxide particles having reactive acryloyl or methacryloyl group and a monomer having low molecular weight and a larger number of functional group, that is a monomer having higher reactive functional group density Ac/M, in comparison with the oligomer having a molecular weight of more than 1,000. A self cleavage type initiator may be preferably employed, if necessary, in this instance.

Though the hardened layer obtained by employing a monomer having methacryloyl group is more difficult to generate image blur due to NOx absorption than that employing acryl monomer, there is disadvantage that a high hardness can not be obtained due to low reactivity. However, when a monomer having a methacryloyl group is reacted with tin oxide particles having a reactive acryloyl or methacryloyl group as a polymerizable unsaturated group, a layer having higher hardness is obtained than that produce employing other metal oxide having higher refractive index, since UV ray transmits through the layer well during UV ray exposure because of low refractive index of tin oxide, and therefore, polymerization is progressed by sufficient UV exposure amount.

(Tin Oxide Particles Having an Acryloyl or Methacryloyl Group)

Tin oxide particles having an acryloyl or methacryloyl group employed in this invention is described.

Tin oxide particles having an acryloyl or methacryloyl group used in this invention can be prepared by a method wherein a compound represented by the Formula (1) is allowed to react with the tin oxide particles. The tin oxide particles which have not been subjected to a surface treatment have hydroxy groups on their surface in general. The compounds represented by the Formula (1) are described as a surface treating agent in this specification.

Formula (1)

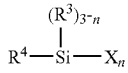

$R^3$ is an alkyl having carbon atoms of from 1 to 10 or an aralkyl having carbon atoms of from 6 to 10, $R^4$ is an organic group having a reactive acryloyl or methacryloyl group, X is a halogen atom, an alkoxy, acyloxy, aminooxy or phenoxy group, n is an integer of from 1 to 3.

$R^3$ is preferably a hydrogen atom, and a methyl or ethyl group.

X contributes to a reaction with hydroxy groups on the surface of the tin oxide particles, and preferably halogen atoms, particularly a chlorine atom, and an alkoxy group, particularly a methoxy and ethoxy group.

Examples of the compound represented by Formula (1) include:

S-1 $CH_2{=}CHCOO(CH_2)_2Si(CH_3)(OCH_3)_2$
S-2 $CH_2{=}CHCOO(CH_2)_2Si(OCH_3)_3$
S-3 $CH_2{=}CHCOO(CH_2)_3Si(CH_3)(OCH_3)_2$
S-4 $CH_2{=}CHCOO(CH_2)_3Si(OCH_3)_3$
S-5 $CH_2{=}CHCOO(CH_2)_2Si(CH_3)Cl_2$
S-6 $CH_2{=}CHCOO(CH_2)_2SiCl_3$
S-7 $CH_2{=}CHCOO(CH_2)_3Si(CH_3)\ Cl_2$
S-8 $CH_2{=}CHCOO(CH_2)_3SiCl_3$
S-9 $CH_2{=}C(CH_3)COO(CH_2)_2Si(CH_3)(OCH_3)_2$
S-10 $CH_2{=}C(CH_3)COO(CH_2)_2Si(OCH_3)_3$
S-11 $CH_2{=}C(CH_3)COO(CH_2)_3Si(CH_3)(OCH_3)_2$
S-12 $CH_2{=}C(CH_3)COO(CH_2)_3Si(OCH_3)_3$
S-13 $CH_2{=}C(CH_3)COO(CH_2)_2Si(CH_3)Cl_2$
S-14 $CH_2{=}C(CH_3)COO(CH_2)_2SiCl_3$
S-15 $CH_2{=}C(CH_3)COO(CH_2)_3Si(CH_3)Cl_2$
S-16 $CH_2{=}C(CH_3)COO(CH_2)_3SiCl_3$
S-17 $CH_2{=}CHCOOSi(OCH_3)_3$
S-18 $CH_2{=}CHCOOSi(OC_2H_5)_3$
S-19 $CH_2{=}C(CH_3)COOSi(OCH_3)_3$

S-20 $CH_2{=}C(CH_3)COOSi(OC_2H_5)_3$
S-21 $CH_2{=}C(CH_3)COO(CH_2)_3Si(OC_2H_5)_3$
S-22 $CH_2{=}CHCOO(CH_2)_2Si(CH_3)_2(OCH_3)$
S-23 $CH_2{=}CHCOO(CH_2)_2Si(CH_3)(OCOCH_3)_2$
S-24 $CH_2{=}CHCOO(CH_2)_2Si(CH_3)(ONHCH_3)_2$
S-25 $CH_2{=}CHCOO(CH_2)_2Si\ (CH_3)(OC_6H_5)_2$
S-26 $CH_2{=}CHCOO(CH_2)_2Si(C_{10}H_{21})(OCH_3)_2$
S-27 $CH_2{=}CHCOO(CH_2)_2Si(CH_2C_6H_5)(OCH_3)_2$

The silane compounds may be used singly or by mixing two or more.

Preparation Method of Tin Oxide Particles Having Reactive Organic Group

The tin oxide particles having a reactive acrylic or methacrylic group can be obtained by surface treatment of the tin oxide particles with a compound having a reactive acrylic or methacrylic group, for example, one represented by the formula (I). The compound having a reactive acrylic or methacrylic group of 0.1 to 100 parts by weight as the surface treating agent and a solvent of 50 to 5,000 parts by weight are used for 100 parts by weight of tin oxide particles by employing wet type medium dispersion apparatus for the surface treatment.

A surface treatment method is described to prepare tin oxide particles uniformly and minutely surface treated with the compound having a reactive (meth)acrylic group.

Tin oxide particles are pulverized into minute particles, and simultaneously, surface treatment of the tin oxide particles is progressed by pulverizing in wet method wherein slurry containing tin oxide particle and silane compound surface treatment agent (suspension of solid particles). After that particulates are formed by removing solvent, tin oxide particles surface of which is treated with uniform and minute silane compound can be obtained.

A wet type medium dispersion apparatus used for the surface treatment comprises a container filled with beads as medium, and it crushes aggregation of tin oxide particles to pulverize and disperse by rotating stirring disk arranged perpendicular to rotation shaft with high speed. Various type of apparatus such as longitudinal or horizontal, continuous or batch type, may be employed as far as it disperses the tin oxide particles and capable of surface treating. Practical examples include sand mill, ultravisco mill, pearl mill, grain mill, DYNO-MILL, agitator mill, and dynamic mill. The dispersion apparatus employs pulverizing medium such as balls and beads, to make fine pulverizing and dispersing via impact pressure crushing, friction, shearing, shearing stress and so on.

Beads applicable to sand grinder include balls made of glass, alumina, zircon, zirconia, steal, flint stone, and zircon or zirconia beads are preferable. Beads having particle diameter of 0.3 to 1.0 mm are preferably used in this invention though those having particle diameter of 1 to 2 mm are used usually.

Various materials such as stainless steal, nylon, or ceramics may be used for a disk or inner wall of the wet type medium dispersion apparatus in general, and disk or inner wall made by ceramics such as zirconia or silicone carbide are particularly preferable.

The tin oxide particles having a reactive acryloyl or methacryloyl group can be obtained by surface treatment employing the compound such that represented by Formula (1) via the wet processing described above. The tin oxide particles having a reactive acryloyl or methacryloyl group means that hydroxy groups on the surface of the tin oxide particles and the compound having silyl group form a chemical bonding through hydrolysis reaction. Tin oxide particles are allowed to have a reactive acryloyl or methacryloyl group endowed from the silane compound such that represented by Formula (1) by a coupling reaction.

The tin oxide particles having a reactive acrylic or methacrylic group can form a protective layer by a reaction with a hardenable compound, described below.

[Hardenable Monomer Having Reactive Methacrylic Group]

The hardenable monomer having a reactive methacryl group (referred also as "a hardenable compound"), which reacts with a reactive acryl group or a methacryl group of the tin oxide particles, may be used.

The hardenable compounds may be used independently or mixing with two or more different type compounds.

Examples of the hardenable compounds are listed.

Methacrylic compounds refer to compounds having a methacryloyl group ($CH_2{=}CCH_3CO$—) in this invention. Further, number of Ac groups as described herein, refers to the number of the methacryloyl groups.

| No. | | Ac number |
|---|---|---|
| 1 | 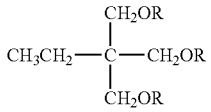 | 3 |
| 2 | 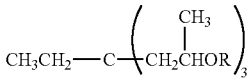 | 3 |
| 3 | 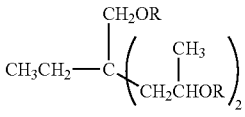 | 3 |
| 4 | 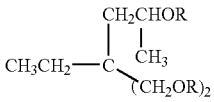 | 3 |
| 5 | 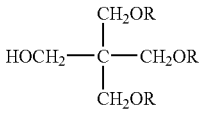 | 3 |
| 6 | 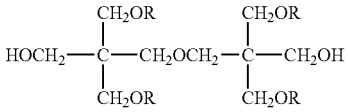 | 4 |
| 7 | 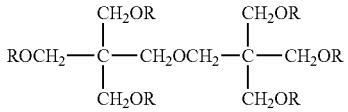 | 6 |
| 8 | 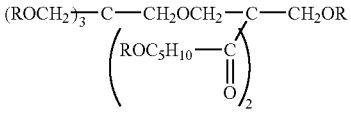 | 6 |

-continued
| No. | | Ac number |
|---|---|---|
| 9 | 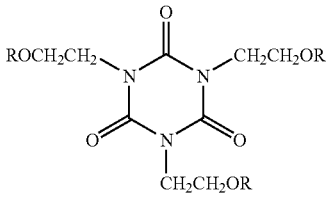 | 3 |
| 10 | $CH_3CH_2C(CH_2OC_3H_6OR)_3$ | 3 |
| 11 | 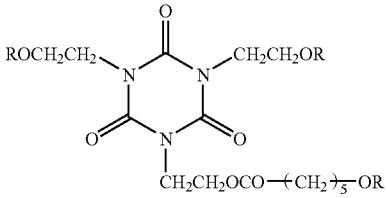 | 3 |
| 12 | $(ROCH_2)_3C—O—C(CH_2OR)_3$ | 6 |
| 13 | $(ROCH_2)_3C—CH_2OCH_2—C(H)(CH_2OR)_2$ | 5 |
| 14 | $(ROCH_2)_3C—CH_2OCH_2—C(CH_3)(CH_2OR)_2$ | 5 |
| 15 | $(ROCH_2)_3C—CH_2OCH_2—C(CH_2OH)(CH_2OR)_2$ | 5 |
| 16 | $(ROCH_2)_3C—CH_2OCH_2—C(CH_2OR)(CH_2OH)_2$ | 4 |
| 17 | $(ROCH_2)_3C—O—C(CH_2OH)(CH_2OR)_2$ | 5 |
| 18 | 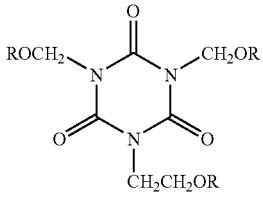 | 3 |
| 19 | $CH_3CH_2C(CH_2CH_2OR)_3$ | 3 |
| 20 | 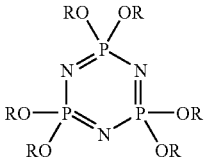 | 6 |
-continued
| No. | | Ac number |
|---|---|---|
| 21 | 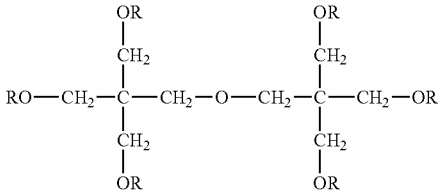 | 6 |
| 23 | $R(OC_3H_6)_3OR$ | 2 |
| 24 | 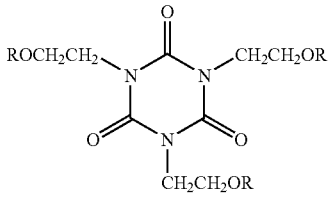 | 3 |
| 25 | 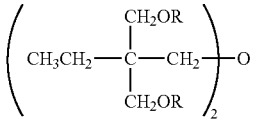 | 4 |
| 26 | $(ROCH_2)_4C$ | 4 |
| 27 | $RO—C_6H_{12}—OR$ | 2 |
| 28 | 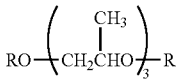 | 2 |
| 29 | 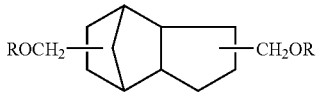 | 2 |
| 30 | 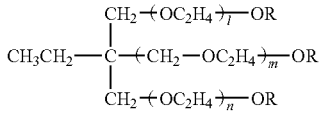 (l + m + n = 3) | 3 |
| 31 | $(ROCH_2)_3CCH_2OCONH(CH_2)_6NHCOOCH_2C(CH_2OR)_3$ | 6 |
| 32 | 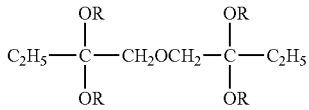 | 4 |
| 33 | 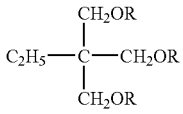 | 3 |
| 34 | 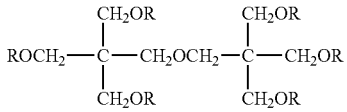 | 6 |

-continued

| No. | | Ac number |
|---|---|---|
| 35 | 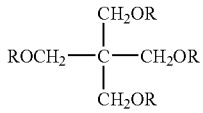 | 4 |

In the above formulae, R is formulated as follows:

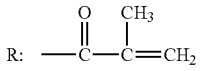

The hardenable compounds of this invention preferably have two or more functional groups. It is preferred that a ratio of Ac/M is not less than 0.005, wherein Ac and M are a number of methacryloyl group and molecular weight, respectively, of the compound having a methacryloyl group.

High crosslinking density is obtained, and anti-abrasion property of the photoreceptor is improved by employing the hardenable compound having Ac/M of not less than 0.005, and further generation of image blur or image flow is inhibited.

When Ac/M is large, number of crosslinking in the resin is large, and therefore, hardness of the protective layer is high to give increased anti-abrasion property. However the hardness is so high that it is liable to cause cracking of the protective layer or harmful influence to pod life of the coating composition during the preparation, and makes the mage blur or image flow worse. Therefore, Ac/M is preferably not more than 0.05. The ratio Ac/M is preferably not more than 0.01 particularly.

Two or more hardenable compounds having difference functional density may be used in mixture.

Tin Oxide Particles

The tin oxide particles may be manufactured by a conventional method such as a gas phase method, a chlorine method, a sulfuric acid method, a plasma method and electrolytic method. The particles produced by plasma method are preferable because they are minute and uniform, having narrow particle size distribution and uniform crystal habit, and containing less aggregated particles. The particles may have sphere or irregular shape, and smooth or rough surface. Particles having sphere shape and smooth surface are preferable since the surface is treated uniformly by the surface treatment.

A number average primary particle diameter of the tin oxide particles is preferably 1-300 nm, and more preferably 3-100 nm. Anti-abrasion property is not sufficient in case of smaller particle diameter, and there may be possibility that exposure light may be scattered or anti-abrasion property becomes insufficient as the particles inhibit photocuring.

The number average primary particle diameter of the tin oxide particles is obtained by a method in which photograph of magnification factor of 10,000 times is taken via scanning electro-microscopy (manufactured by JEOL Ltd.) and randomly selected 300 particles, excluding aggregated particles, are read in by a scanner. Number average particle diameter is calculated by an automatic image processor LUZEX AP, manufactured by Nireco Corporation, with software ver. 1.32.

Content of the tin oxide particles in the protective layer is preferably 1 to 200 parts with respect to 100 parts by weight, and more preferably 30 to 120 parts by weight, with reference to 100 parts of the hardenable component of the protective layer.

Additives Other than Described Above

The protective layer may be formed by applying a coating composition containing, according to necessity, a polymerization initiator, lubricant particles, anti-oxidant and so on, then it is subjected to reaction to form a hardened layer.

In a reaction of the hardenable compound, a method reacting initiated electron beam cleavage, or a method reacting by light or heat via adding radical polymerization initiator or cation polymerization initiator are employed. A light polymerization initiator or a heat polymerization initiator may be employed. The light and heat polymerization initiators are employed in combination.

Light polymerization initiator is preferable for the radical polymerization initiator of the hardenable compounds. Alkyl phenone type compounds and phosphine oxide type compounds are preferable among them. Compounds having an α-hydroxy acetophenone structure or an acylphosphine oxide structure are particularly preferable. Ion type polymerization initiators composed of aromatic onium compound of diazonium, ammonium, iodonium, sulfonium, and phosphonium of $B(C_6F_5)_4^-$, $PF_6^-$, $AsF_6^-$, $SbF_6^-$, and $CF_3SO_3^-$, or nonion type polymerization initiators such as sulfone compound generating sulfonic acid, halogen compounds generating hydrogen halides, or iron arene complex compounds to initiate cation polymerization. Particularly the nonion type initiators of the sulfone compound generating sulfonic acid and the halogen compounds generating hydrogen halides are preferable.

Compound examples of the photopolymerization initiators used preferably in the present invention will now be listed.

Examples of α-Aminoacetophenone Type Compounds:

Polymerization initiator 1-1

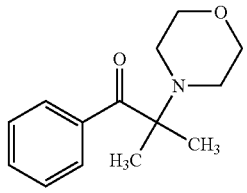

Polymerization initiator 1-2

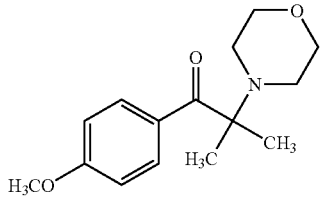

Polymerization initiator 1-3

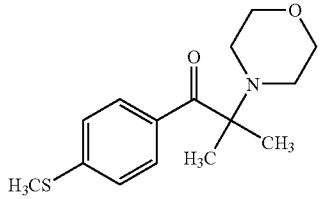

-continued

Polymerization initiator 1-4

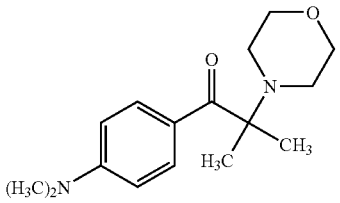

Polymerization initiator 1-5

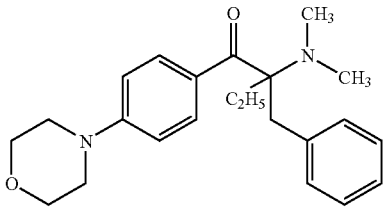

Polymerization initiator 1-6

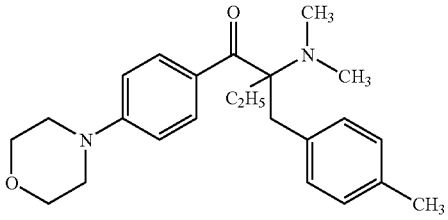

Examples of α-Hydroxy Acetophenone Type Compounds:

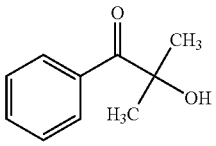

Polymerization initiator 2-1

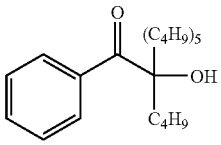

Polymerization initiator 2-2

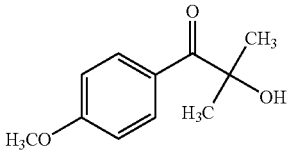

Polymerization initiator 2-3

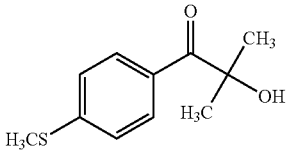

Polymerization initiator 2-4

-continued

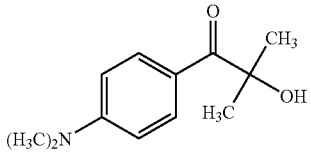

Polymerization initiator 2-5

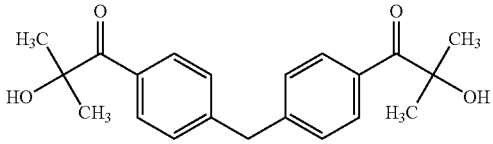

Polymerization initiator 2-5

Examples of Acylphosphine Oxide Type Compounds:

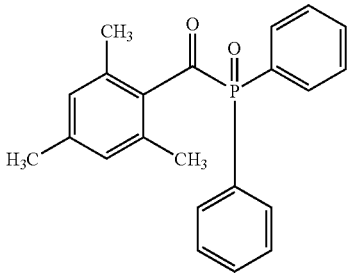

Polymerization initiator 3-1

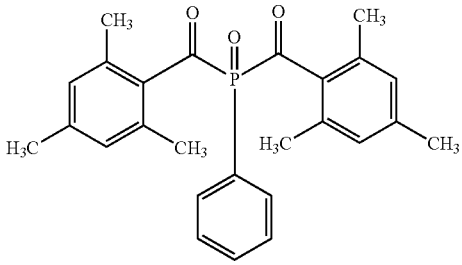

Polymerization initiator 3-2

Examples of Other Radical Type Polymerization Initiator:

Polymerization initiator 4-1

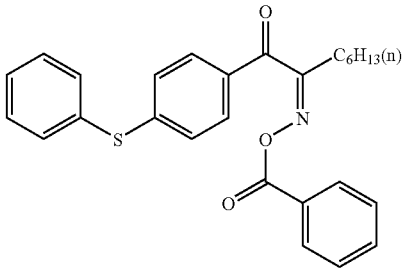

-continued

Polymerization initiator 4-2

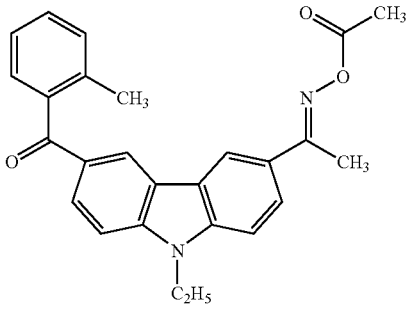

Polymerization initiator 4-3

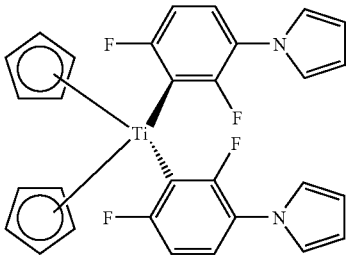

Polymerization initiator 5-1

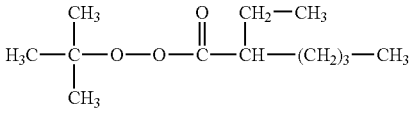

Examples of Nonion Type Polymerization Initiator:

Polymerization initiator 6-1

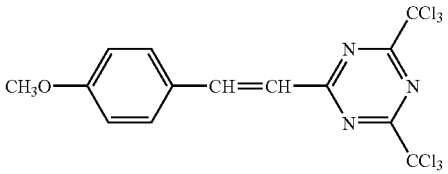

Polymerization initiator 6-2

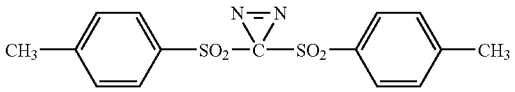

Polymerization initiator 6-3

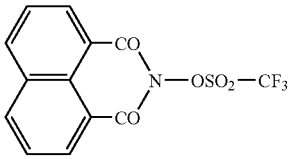

Polymerization initiator 6-4

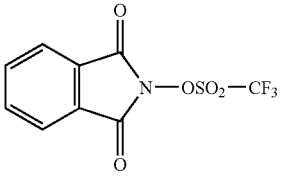

-continued

Polymerization initiator 6-5

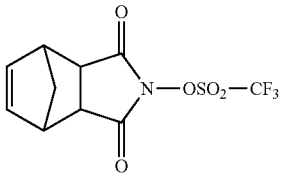

Polymerization initiator 6-6

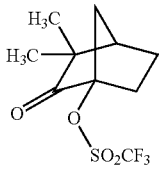

Examples of Ionic Type Polymerization Initiator:

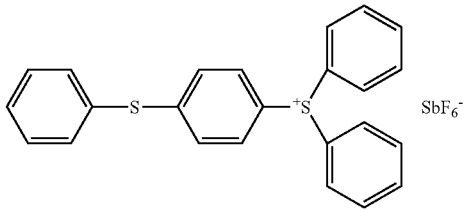

Polymerization initiator 7-1

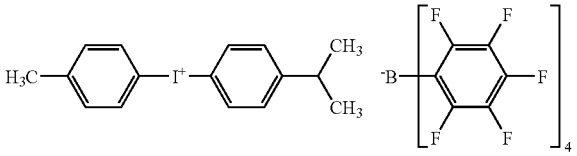

Polymerization initiator 7-2

It is preferably that the protective layer of the present invention is subjected to natural drying or heat drying after having been coated, then the protective layer is made to react by exposure to actinic radiation or by heating.

Similarly to the case of the intermediate layer or photosensitive layer, the protective layer can be coated according to such methods as dip coating, spray coating, spinner coating, bead coating, blade coating, beam coating, and slide hopper coating methods.

For the photoreceptor of the present invention, the following step is preferably used Actinic radiation is applied to a coating layer to generate radicals and cause polymerization. Intermolecular and intramolecular crosslinking is formed by a crosslinking reaction, and curing is performed to generate a cured resin. It is preferred in particular to use an ultraviolet ray and electron beam as actinic radiation.

There is no particular restriction to the ultraviolet light source if ultraviolet rays can be emitted. It is possible to use a low pressure mercury lamp, intermediate pressure mercury lamp, high pressure mercury lamp, extra-high pressure mercury lamp, carbon arc lamp, metal halide lamp, xenon lamp, flash or pulse xenon and others. Irradiation conditions differ according to each lamp. The dose of actinic radiation is normally in the range of 5 to 500 mJ/cm$^2$, preferably in the range of 5 to 100 mJ/cm$^2$. The electric power of the lamp is preferably in the range of 0.1 kW through 5 kW, more preferably in the range of 0.5 kW through 3 kW.

The electron beam irradiation apparatus as the electron beam source include, generally, a curtain beam type that produces high power at less costs is effectively used as an electron beam accelerator for emitting the electron beam. The acceleration voltage at the time of electron beam irradiation is preferably in the range of 100 through 300 kV. The absorbed dose is preferably kept in the range of 0.5 through 10 Mrad.

The irradiation time to get the required dose of actinic radiation is preferably 0.1 sec to 10 min., and is more preferably 0.1 sec to 5 min.

Ultraviolet rays are easy to use as actinic radiation, and are preferably used.

The protective layer of the photoreceptor can be dried before and during irradiation with actinic radiation. Appropriate timing for drying can be selected by a combination thereof.

Appropriate drying conditions can be selected according to the type of solvent and film thickness. The drying temperature is preferably from the room temperature to 180° C., more preferably from 80° C. to 140° C. Drying time is preferably 1 min to 200 min, more preferably 5 min to 100 min.

The film thickness of the protective layer is preferably in the range of 0.2 through 10 μm, more preferably in the range of 0.5 through 6 μm.

Conductive Support

There is no restriction to the support used in the present invention if it is conductive. The examples are:

a drum or a sheet formed of such a metal as aluminum, copper, chromium, nickel, zinc and stainless steel;

a plastic film laminated with such a metal foil as aluminum and copper;

a plastic film provided with vapor deposition of aluminum, indium oxide, and tin oxide; and a metal, plastic film, or paper provided with a conductive layer by coating a conductive substance independently or in combination with a binder resin.

Intermediate Layer

An intermediate layer having a barrier function and adhesion function can be provided between the conductive layer and a photosensitive layer in the present invention.

To form the intermediate layer, such a binder resin as casein, polyvinyl alcohol, nitrocellulose, ethylene-acrylic acid copolymer, polyamide, polyurethane or gelatin is dissolved in a solvent, and the intermediate layer can be formed by dip coating. Of these materials, alcohol soluble polyamide resin is preferably used.

The solvent used for preparation of the intermediate layer is preferably capable of effective dispersion of inorganic particles and dissolution of polyamide resin. The preferred solvent is exemplified by alcohols containing 2 through 4 carbon atoms such as ethanol, n-propyl alcohol, isopropyl alcohol, n-butanol, t-butanol, and sec-butanol having excellent polyamide resin dissolution and coating performances. Further, to improve the storage ability and particle dispersion, it is possible to use an auxiliary solvent providing excellent effects when used in combination with the aforementioned solvent. The examples of such an auxiliary solvent are methanol, benzyl alcohol, toluene, methylene chloride, cyclohexane, and tetrahydrofuran.

The concentration of the binder resin is selected as appropriate in conformity to the film thickness of the intermediate layer and production speed.

When inorganic particles are dispersed in the binder resin, the amount of the mixed inorganic resin is preferably in the range of 20 through 400 parts by weight, more preferably in the range of 50 through 200 parts by weight, with respect to 100 parts by weight of the binder resin.

An ultrasonic homogenizer, ball mill, sand grinder, and homomixer can be used to disperse the inorganic particles.

The method of drying the intermediate layer can be selected as appropriate in conformity to the type of solvent and film thickness. The method of drying by heat is preferably used.

The film thickness of the intermediate layer is preferably 0.1 to 15 μm, more preferably 0.3 through 10 μm.

Photosensitive Layer

A coupled photosensitive layer composed of a charge generation layer and a charge transfer layer is preferable.

Charge Generation Layer

The charge generation layer is preferably a layer that contains a charge generation material and a binder resin, and is formed by dispersing the charge generation material in the binder resin solution, and coating the same.

The charge generation material is exemplified by an azo material such as Sudan Red and Diane Blue; quinone pigment such as pyrene quinone and anthanthrone; quinocyanine pigment; perylene pigment; indigo pigment such as indigo, and thioindigo; and phthalocyanine pigment. These charge generation materials can be used independently or in the form dispersed in the resin.

The conventional resin can be used as the binder resin of the charge generation layer. Such a resin is exemplified, by polystyrene resin, polyethylene resin, polypropylene resin, acryl resin, methacryl resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, copolymer resin containing two or more of these resins (e.g., vinyl chloride-vinyl acetate copolymer, vinyl chloride-vinyl acetate-anhydrous maleic acid copolymer), and polyvinyl carbazole resin.

The charge generation layer is preferably formed as follows: The charge generation material is dispersed by a homogenizer into solution obtained by dissolving a binder resin in solvent, whereby a coating composition is prepared. Then the coating composition is coated to a predetermined thickness using a coating device. After that, the coated film is dried, whereby the charge generation layer is formed.

The examples of the solvent used for dissolving the binder resin used for preparing the charge generation layer and coating include toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1-dioxane, 1,3-dioxolane, pyridine and diethyl amine.

An ultrasonic homogenizer, ball mill, sand grinder, and homomixer can be used to disperse the charge generation material.

The amount of the charge generation material is preferably 1 through 600 parts by weight of the charge generation material, more preferably 50 through 500, with respect to 100 parts by weight of binder resin. The film thickness of the charge generation layer differs according to the characteristics of the charge generation material and binder resin and percentage of mixture, and is preferably 0.01 through 5 μm, more preferably 0.05 through 3 μm. An image defect can be prevented from occurring by filtering out the foreign substances and coagulants before applying the coating composition for the charge generation layer. It can be formed by vacuum evaporation coating of the aforementioned pigment.

Charge Transport Layer

The charge transport layer used in the photosensitive layer contains a charge transport material and binder resin, and is formed by dissolving the charge transport material in the binder resin and coating the same.

The charge transport material is exemplified by carbazole derivatives, oxazole derivatives, oxadiazole derivatives, triazole derivatives, thiadiazole derivatives, triazole derivatives, imidazole derivatives, imidazolone derivatives, imidazolidine derivatives, bisimidazolidine derivatives, styryl compound, hydrazone compound, pyrazoline compound, oxazolone derivatives, benzimidazole derivatives, quinazoline derivatives, benzofuran derivatives, acridine derivatives, phenazine derivatives, aminostilbene derivatives, triarylamine derivatives, phenylene diamine derivatives, stilbene derivatives, benzidine derivatives, poly-N-vinyl carbazole, poly-1-vinyl pyrene, and poly-9-vinyl anthracene. Two or more of these substances can be mixed for use.

A compound having an atomic ratio of nitrogen atom of not more than 4.5% is preferably used as a charge transfer material. Examples of the fundamental structure of the charge transfer material include triphenyl amine derivatives, styryl compound, benzidine compound, butadiene compound, and the styryl compound is preferable among them.

The conventional resin can be used as the binder resin for the charge transport layer. The examples include polycarbonate resin, polyacrylate resin, polyester resin, polystyrene resin, styrene-acrylonitrile copolymer resin, polymethacrylate ester resin, and styrene-methacrylate ester copolymer. Polycarbonate is preferably used. Further, BPA (Bisphenol A), BPZ (Bisphenol Z), dimethyl BPA, and BPA-dimethyl BPA copolymers are preferably used because of excellent resistance to cracks and anti-abrasion, and charge characteristics.

The charge transport layer is preferably formed by dissolving binder resin and a charge transport material to prepare a coating composition, which is then applied to the layer to a predetermined thickness. Then the coating layer is dried.

The examples of the solvent for dissolving the binder resin and charge transport materials include toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethyl amine, without being restricted thereto.

The amount of charge transport material is preferably in the range of 10 through 500 parts by weight of charge transport material, more preferably in the range of 20 through 100 parts by weight, with respect to 100 parts by weight of binder resin.

The thickness of the charge transport layer varies according to the characteristics of the charge transport material and binder resin, and percentage of mixture, and is preferably 5 through 40 μm, more preferably 10 through 30 μm.

An antioxidant, electronic conductive agent, and stabilizer can be applied to the charge transport layer. The antioxidants listed in JP-A 2000-305291, and electronic conductive agents listed in JP-A S50-137543 and JP-A S58-75483 are preferably used.

Image Forming Apparatus

An image forming apparatus to which the organic photoreceptor may be applied, and a process cartridge used in the apparatus are described.

The image forming apparatus 1 shown in FIG. 1 is a digital type image forming apparatus, and is structured by an image reading section A, image processing section B, image forming section C, and transfer sheet conveyance section D.

An automatic document feeding unit to automatically convey documents is provided on the upper portion of the image reading section A, and the documents placed on a document placement board 11 are separated one by one sheet and conveyed by a document conveyance roller 12, and an image is read at a reading position 13*a*. The document whose reading is completed, is delivered by the document conveyance roller 12 onto a document sheet delivery tray 14.

An image of the document when it is placed on a platen glass 13, is read out by a reading operation at a speed of v of the first mirror unit 15 which is composed of an illumination lamp and the first mirror, and by a moving exposure at a speed of v/2 of the second mirror unit 16 in the same direction which is composed of the second mirror and the third mirror, which are positioned in V-letter shape, wherein the first mirror unit 15 and the second mirror unit constitute a scanning optical system.

The read image is formed on the light receiving surface of an image pick-up element CCD, which is a line sensor, through a projection lens 17. A line-shaped optical image formed on the image pick-up element CCD is successively electro-optical converted into electrical signal (brightness signal), then A/D converted, and after processing such as density conversion, filter processing, or the like, is conducted in an image processing section B, the image data is temporarily stored in a memory.

In the image forming section C, as image forming units, around the outer periphery of a drum-like photoreceptor 21, a charger 22 to charge on the photoreceptor, a potential detecting device 220 to detect the potential on the photoreceptor, a developing unit 23, a transfer belt 45, a cleaning unit 26 cleaning the photoreceptor, and pre-charge lamp (PCL) 27 eliminating potential by light on the photoreceptor are respectively arranged in the order of operation. A reflective density meter 222, which measures reflective density of developed patch image, is equipped on the photoreceptor at the down stream of the developer 23. The photoreceptor drum 21 according to this invention is rotated clockwise in the drawing.

After uniform charging by the charger 22 is conducted on the rotating the photoreceptor 21, image exposure is conducted by the exposure optical system 30 according to an image signal read from the memory of the image processing section B. The exposure optical system 30, which is a writing unit, uses a laser diode, not shown, as a light emitting source, and an optical path is changed by a reflection mirror 32 through a rotating polygonal mirror 31, fθ lens 34, and cylindrical lens 35, and the primary scanning is conducted. The image exposure is conducted at position Ao on the photoreceptor drum 21, and a latent image is formed by the rotation (the subsidiary scanning) of the photoreceptor drum 21. In the present example, exposure is conducted on a portion having characters and a reversal latent image is formed.

A semiconductor laser or an emission diode having oscillation wave length of 350-800 nm is employed for image exposure to form a latent image on the photoreceptor in this invention. An electrophotographic image having 400-2,500 dpi high definition can be obtained by employing these exposing light source with exposing laser light beam spot of 10-100 μm in the primary scanning direction and exposing digitally.

The laser light beam spot is a radius of a length of exposing beam (Ld) measured at the maximum position along with a primary scanning direction in an area having exposing intensity of more than $1/e^2$ times of peak intensity of the exposing light beam.

Image exposure is conducted by light beam employing a scanning optical system such as semiconductor laser, and a solid scanner such as LED. The light beam intensity distribution includes Gaussian, Lorentzian and so on. The area having exposing intensity of more than $1/e^2$ times of peak intensity of the exposing light beam is the light beam spot.

The latent image on the photoreceptor drum 21 is reversal-developed by the developing unit 23, and a visual image by a toner is formed on a surface of the photoreceptor drum 21. A polymerization toner for the developer is preferably used. An electrophotography having better sharpness can be obtained by employing the polymerization toner having uniform shape and particle size distribution in combination with the photoreceptor of the present invention.

In the transfer sheet conveyance section D, sheet feed units 41(A), 41(B), and 41(C) in which different sized transfer sheet P are accommodated, are provided in the lower portion of the image forming unit, and on the side portion, a manual sheet feed unit 42 to conduct the manual sheet feed is provided, and the transfer sheet selected from any one of these sheet feed units, is fed along a sheet feed path 40 by a guiding roller 43. The transfer sheet P is temporarily stopped and then fed by the register roller 44 by which inclination and deflection of the feeding transfer sheet are corrected, and through a sheet feed path 40, a pre-transfer roller 43*a*, a paper providing pass 46 and an entrance guide plate 47, the toner image on the photoreceptor drum 21 is transferred onto the transfer sheet P at the transfer position Bo by the transfer electrode 24 and separation electrode 25, during conveyed via transfer conveying belt 454 of the transfer conveying unit 45. The transfer sheet P is separated from the photoreceptor drum 21 surface, and conveyed to the fixing unit 50 by the transfer conveying unit 45.

The fixing unit 50 has a fixing roller 51 and a pressure roller 52, and the transfer sheet passes between the fixing roller 51 and the pressure roller 52, thereby, toner is fused by heat and pressure. The transfer sheet P, on which the toner image has been fixed, is delivered onto the sheet delivery tray 64.

The situation for image forming on one side of the image receiving sheet is described above. When the copies are made on both sides of the sheet, the paper outputting course changing member 170 is switched so that the image receiving paper guiding member 177 is opened and the image receiving paper P is conveyed in the lower direction.

The image receiving paper P is conveyed to the lower direction by a conveying mechanism 178 and switch-backed, so as to become the tail of the paper to top, and guided into a paper supplying unit for double-face copying 130.

The image receiving paper P is conveyed to paper supplying direction on the conveying guide 131 provided in the paper supplying unit for double-face copying 130 and resupplied by the paper supplying roller 132 and guided to the conveying course 40.

The image receiving paper P is conveyed to the photoreceptor 21 and a toner image is transferred onto the back side of the image receiving paper P, and output onto the paper output tray 64 after fixing the toner image by the fixing unit 50, as mentioned above.

In the image forming method according to the invention, the photoreceptor and another member such as the developing unit and the cleaning unit may be combined as a unit of a processing cartridge which can be freely installed to and released from the main body of the apparatus. Besides, at least one of the charging unit, imagewise exposing unit, developing unit, transferring or separating unit and cleaning unit may be unitized with the photoreceptor to form a processing cartridge which is able to be freely installed to or released from the main body of the apparatus using a guiding means such as a rail.

Figure 2:
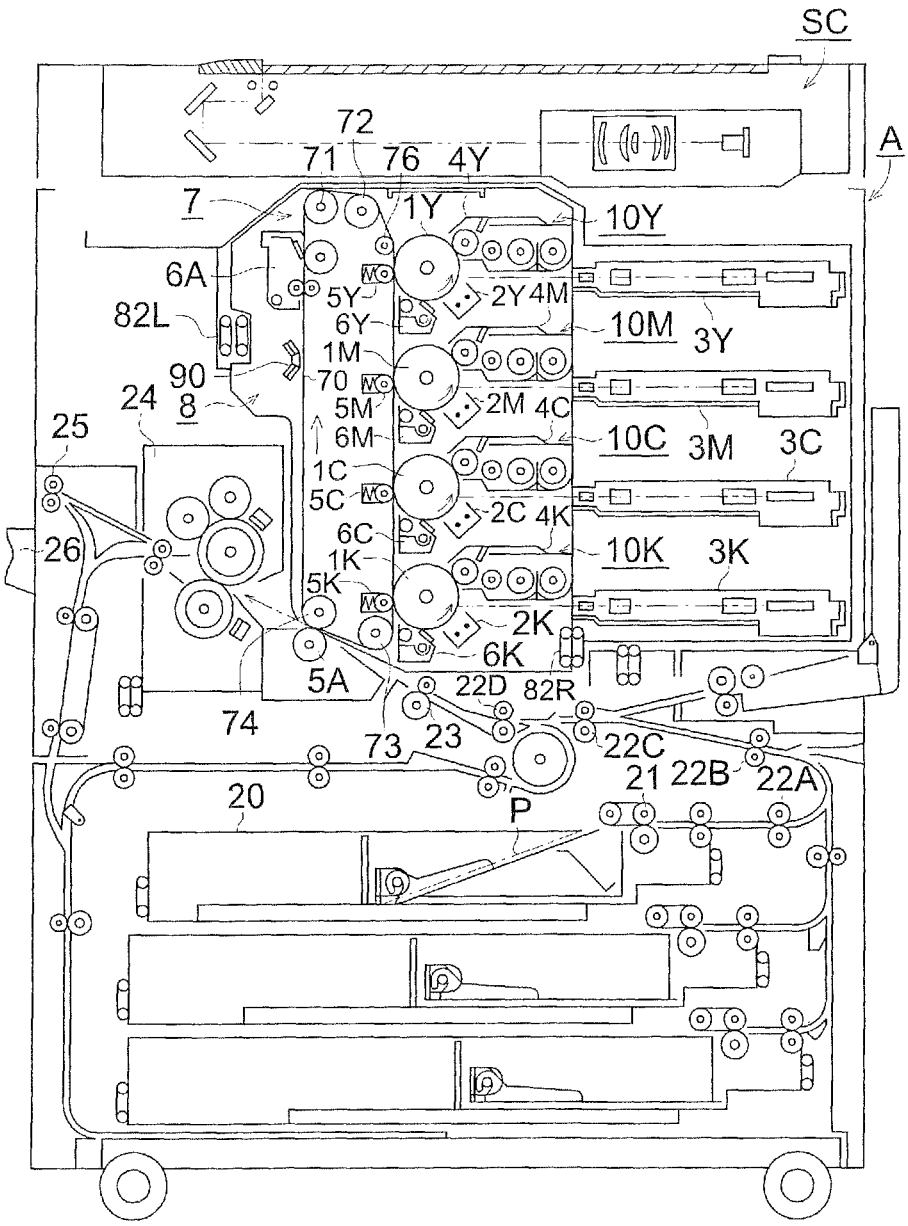
FIG. 2: A schematic view of a color image forming apparatus in which the organic photoreceptor is applied.

FIG. 2 is a schematic view of an example of a color image forming apparatus.

The color image forming apparatus is one so called as a tandem type color image forming apparatus, in which plural image forming units 10Y, 10M, 10C and 10Bk, an endless belt-shaped intermediate transfer unit 7, a paper conveying unit 21 and a fixing unit 24 are equipped. An original image reading unit SC is arranged at the upper portion of the main body of the image forming apparatus.

The image forming unit 10Y for forming a yellow colored image has a drum-shaped photoreceptor 1Y as a primary image carrier, and a charging unit 2Y, exposing unit 3Y, developing unit 4Y, a primary transfer roller 5Y as a primary transfer unit and a cleaning unit 6Y which are arranged around the photoreceptor 1Y. The image forming unit 10M for forming a magenta colored image has a drum-shaped photoreceptor 1M, and a charging unit 2M, exposing unit 3M, developing unit 4M, a primary transfer roller 5M as a primary transfer unit and a cleaning unit 6M. The image forming unit 10C for forming a cyan colored image has a drum-shaped photoreceptor 1C, and a charging unit 2C, exposing unit 3C, developing unit 4C, a primary transfer roller 5C as a primary transfer unit and a cleaning unit 6C. The image forming unit 10Bk for forming a black colored image has a drum-shaped photoreceptor 1Bk, and a charging unit 2Bk, exposing unit 3Bk, developing unit 4Bk, a primary transfer roller 5Bk as a primary transfer unit and a cleaning unit 6Bk.

The four image forming units 10Y, 10M, 10C and 10Bk are composed of rotating charge unit 2Y, 2M, 2C and 2BK, image exposing unit 3Y, 3M, 23C and 3BK, rotating developing unit 4Y, 4M, 4C and 4BK, and cleaning unit 5Y, 5M, 5C and 5BK, each cleaning the photoreceptor drums 1Y, 1M, 1C and 1BK, around the photoreceptor drums 1Y, 1M, 1C and 1BK.

The image forming units 10Y, 10M, 10C and 10Bk are similar except that the color of toner image formed on the photoreceptors 1Y, 1M, 1C and 1BK are different, and therefore, the description is detailed representatively taking the image forming unit 10Y.

The image forming units 10Y is composed of charging unit 2Y, exposing unit 3Y, developing unit 4Y and cleaning unit 5Y arranged around a photoreceptor drum 1Y, to form yellow toner image on the photoreceptor drum 1Y. At least the photoreceptor drum 1Y, charging unit 2Y, developing unit 4Y and cleaning unit 5Y are provided integrally among the image forming unit 10Y in one of the embodiment of this invention.

The charging unit 2Y gives uniform potential to the photoreceptor drum 1Y, and a corona discharge type charger 2Y is provided for the photoreceptor drum 1Y.

The image exposure unit 3Y exposes light according to yellow image signal to the photoreceptor 1Y, on which uniform potential has been given by charger 2Y, so as to form a latent image corresponding to the yellow image. Examples of the exposure unit include one composed of LED array emission elements and image forming elements such as SELFOC lens, arranged around the axis of the photoreceptor, and a laser optical system.

The present electrophotographic image forming apparatus is constituted in such a manner that components such as the photoreceptor, development unit, cleaning unit the like are integrated as a cartridge, and this unit may be detachable from the main frame. Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main frame.

The endless belt-shaped intermediate transfer unit 7 has a semiconductive endless belt-shaped transfer member 70 as a secondary image carrier which is wound on plural rollers and circulatably held.

Color images formed in the image forming units 10Y, 10M, 10C and 10Bk, respectively, are successively transferred onto the circulating endless belt-shaped intermediate transfer member 70 by the primary transfer rollers 5Y, 5M, 5C and 5Bk as the primary transfer unit, thus a color image is synthesized. Paper P as a recording material (a support carrying the finally fixed image such as a plain paper sheet and a transparent sheet) stocked in a paper supplying cassette 20 is supplied by a paper supplying unit 21, and conveyed to a secondary transfer roller 5A as a secondary transferring means through intermediate conveying rollers 22A, 22B, 22C and 22D and a register roller 23. Then the color image is collectively transferred by the secondary transferring onto the paper P. The color image transferred on the paper P is fixed by the fixing unit 24 and conveyed by an output roller 25 to be stood on an output tray 26.

Besides, the toner remained on the endless belt intermediate transfer member 70 is removed by the cleaning unit 6A after the color image is transferred to the paper P by the secondary transfer roller 5A and the paper P is separated by curvature from the intermediate transfer belt.

In the course of the image formation process, the primary transfer roller 5Bk is always pressed to the photoreceptor 1Bk. The other primary transfer rollers 5Y, 5M and 5C are each contacted by pressing to the corresponding photoreceptors 1Y, 1M and 1C, respectively, only for the period of image formation.

The secondary transfer roller 5A is contacted by pressing to the endless belt-shaped intermediate transfer member 70 only for the period of the secondary transferring while passing of the paper P.

A frame 8 can be pulled out from the main body A of the apparatus through supporting rails 82L and 82R.

The frame 8 comprises the image forming units 10Y, 10M, 10C and 10Bk, and an intermediate transfer unit 7 comprising the endless belt-shaped intermediate transfer member 70.

The image forming units 10Y, 10M, 10C and 10Bk are serially arranged in the perpendicular direction. In the drawing, the endless belt-shaped intermediate transfer unit 7 is arranged at left side of the photoreceptors 1Y, 1M, 1C and 1Bk. The endless belt-shaped intermediate transfer unit 7 included the circulatable endless belt-shaped intermediate transfer member 70 wound with the rollers 71, 72, 73 and 74, the primary transfer rollers 5Y, 5M, 5C and 5Bk, and the cleaning unit 6A.

Toner and Developer

A latent image formed on the photoreceptor is visualized to a toner image via development. The toner used in the development includes pulverized toner or polymerization toner, and polymerization toner is preferable because stable particle size distribution is obtained.

In the polymerization toner, the shape of toner particles are formed by a polymerization of monomer raw material of the binder resin material and, if necessary, a chemical process thereafter. Practically, the toner is prepared by polymerization such as suspension polymerization or emulsion polymerization and a process of fusing particles after the polymerization.

Volume average particle diameter of the toner, i.e. 50% volume particle (Dv 50), is preferably 2 to 9 μm, and more preferably 3 to 7 μm. High resolution of the image is obtained by employing toner having such particle size distribution condition. Further, the toner can be composed of reduced content of minute particle size though the toner is small particle size toner, and color reproduction of dot image is improved for long time and toner image having good sharpness and stability can be obtained.

The toner of the present invention can be used in the form of a one-component developer and two-component developer.

The one-component developer to be used includes the non-magnetic one-component developer and the magnetic one-component developer formed by about 0.1 μm through 0.5 μm of magnetic particles contained in the toner. Both of them can be used.

The developer can be mixed with a carrier and can be used as a two-component developer. Examples of the carrier are conventional magnetic particles as exemplified by metals such as iron, ferrite and magnetite, and alloys between these metals and such metals as aluminum and lead. Use of the ferrite particles is preferred in particular. The particle size of the aforementioned carrier is preferably 15 to 100 μm in terms of mass-average particle size, more preferably 25 to 80 μm.

The carrier particle size can be measured typically by the laser diffraction type particle size distribution measuring instrument "HELOS" (by Sympatec Inc.).

The preferred carrier is the one whose magnetic particles are coated further with resin, or the so-called resin dispersed carrier wherein magnetic particles are dispersed in resin. There is no particular restriction to the type of the resin for coating. For example, olefin resin, styrene resin, styrene-acrylic resin, silicone resin, ester resin, or fluorine-containing polymer resin are used. Further, there is no particular restriction to the type of the resins for constituting the resin dispersed carrier. The conventionally known resins can be used. Examples are styrene-acrylic resin, polyester resin, fluorine resin, and phenol resin. The carrier coated with styrene-acrylic resin out of these examples is preferably used because of the excellent performances in preventing the external additive agent from being separated, or in enhancing durability.

EXAMPLES

The invention is illustrated by means of Examples. The term "parts" means parts by weight.

Preparation of Photoreceptor 1

The photoreceptor 1 was produced as follows.

<Electroconductive Support>

The cylinder type aluminum support having machine surface was prepared, which surface has surface roughness Rz of 1.5 μm, having outer diameter of 60 mm and length of 360 mm.

<Interlayer>

Dispersion of the compound formulated as below was diluted twice by the same solvent, and was filtered by RIGIMESH 5 mm filter manufactured by Nihon Pall Ltd. after allowing it to stand over night to prepare a coating composition for the interlayer.

| | |
|---|---|
| Polyamide resin CM8000, manufactured by Toray Industries, Inc. | 1 part |
| Tin oxide SMT500SAS, manufactured by TAYCA CORPORATION | 3 parts |
| Methanol | 10 parts |

The composition was dispersed in batch process for ten hours employing a sand mill dispersion apparatus.

The coating composition was applied on to the support by dipping so as to obtain an interlayer having dry thickness of 2.0 μm.

<Charge Generation Layer>

The following components were mixed and dispersed by a sand mill for ten hours to prepare a coating composition for charge generation layer.

| | |
|---|---|
| Charge generation material, Titanyl phthalocyanine pigment, having a maximum peak at 27.3° based on a Cu-Kα characteristic X-ray diffraction spectrum measurement | 20 part |
| Polyvinylbutyral resin (#6000-C, manufactured by Denkikagaku Kogyo Kabushiki Kaisha) | 10 parts |
| t-Butyl acetate | 700 parts |
| 4-Methoxy-4-methyl-2-pentanone | 300 parts |

The coating composition was coated on the interlayer by dipping method to form a charge generation layer having dry thickness of 0.3 μm.

<Charge Transport Layer>

| | |
|---|---|
| Charge transport material (4,4'-dimethyl-4''-(β-phenylstyryl)triphenylamine) | 225 parts |
| Binder, Polycarbonate (Z300: manufactured by Mitsubishi Gas Chemical Company, Inc.) | 300 parts |
| Anti-oxidant (Irganox1010, manufactured by Nihon Ciba Geigy K.K.) | 6 parts |
| Tetrahydrofuran | 1,600 parts |
| Toluene | 400 parts |
| Silicone oil (KF-54: manufactured by Shin-Etsu Chemical Co., Ltd.) | 1 part |

The above listed compositions were mixed and dissolved to prepare a coating composition for charge transport layer that was coated on the charge generation layer via circular slide hopper coating machine and dried at 110° C. for 60 minutes to form a charge transport layer having dry thickness of 20 μm.

Preparation of Tin Oxide Particles

Hundred parts by weight of tin oxide having number average primary particle diameter of 30 nm, 30 parts by weight of surface treatment agent, Exemplified compound S-17, and 1,000 parts by weight of methylethylketone were charged in wet type sand mill containing alumina beads having particle size of 0.5 mm, and they were mixed for 6 hours at 30° C. Methylethylketone and alumina beads were removed. The residue was dried at 60° C. to obtain tin oxide particles 1 having a reactive acryloyl group.

<Protective Layer>

| | |
|---|---|
| Tin oxide particles 1 | 8 parts |
| Hardenable Compound (Exemplified Compound (11) | 10 parts |
| Polymerization Initiator (Exemplified compound Polymerization Initiator No. 1-5) | 10 parts |
| 1-Propyl alcohol | 40 parts |

The above listed components were dispersed sufficiently by mixing and agitation to prepare a coating composition of the protective layer. The coating composition was coated on the charge transport layer employing circular slide hopper to form the protective layer. It was exposed to UV ray by employing metal halide lamp for 1 minute. A protective layer having thickness of 2.0 μm was formed.

Preparation of Photoreceptors 2-19

The photoreceptors were prepared in the same manner as the photoreceptor 1 except that the preparation conditions were modified shown in Table 1. The photoreceptor 19 was prepared by thermal hardening process at 120° C. for 60 minutes in place of UV exposure after the protective layer coating.

TABLE 1

| | | Particles in a protective layer | | | |
|---|---|---|---|---|---|
| | Photo-receptor | Metal | surface treating | Hardenable monomer | |
| No. | No. | oxide | agent | Compound | Reactive group |
| Example 1 | 1 | SnO | S-17 | Compound (11) | Methacryloyl group |
| Comparative Example 1 | 2 | SnO | S-17 | Compound (11), (R is modified to acryloyl group) | Acryloyl group |
| Comparative Example 2 | 3 | SnO | S-17 | Compound (36) | Methacryloyl group |
| Comparative Example 3 | 4 | SnO | S-17 | Compound (36), (R is modified to acryloyl group) | Acryloyl group |
| Comparative Example 4 | 5 | $TiO_2$ | S-17 | Compound (11) | Methacryloyl group |
| Comparative Example 5 | 6 | $TiO_2$ | S-17 | Compound (11), (R is modified to acryloyl group) | Acryloyl group |
| Example 2 | 7 | SnO | S-17 | Compound (23) | Methacryloyl group |
| Comparative Example 6 | 8 | SnO | S-17 | Compound (23), (R is modified to acryloyl group) | Acryloyl group |
| Comparative Example 7 | 9 | SnO | S-17 | Compound (37) | Methacryloyl group |
| Comparative Example 8 | 10 | SnO | S-17 | Compound (37), (R is modified to acryloyl group) | Acryloyl group |
| Comparative Example 9 | 11 | $TiO_2$ | S-17 | Compound (23) | Methacryloyl group |
| Comparative Example 10 | 12 | $TiO_2$ | S-17 | Compound (23), (R is modified to acryloyl group) | Acryloyl group |
| Example 3 | 13 | SnO | S-17 | Compound (29) | Methacryloyl group |
| Example 4 | 14 | SnO | S-19 | Compound (11) | Methacryloyl group |

TABLE 1-continued

| | | | | | |
|---|---|---|---|---|---|
| Example 5 | 15 | SnO | S-2 | Compound (11) | Methacryloyl group |
| Example 6 | 16 | SnO | S-26 | Compound (11) | Methacryloyl group |
| Example 7 | 17 | SnO | S-19 | Compound (32) | Methacryloyl group |
| Example 8 | 18 | SnO | S-19 | Compound (7) | Methacryloyl group |
| Example 9 | 19 | SnO | S-17 | Compound (26) | Methacryloyl group |

| No. | Ac/M | Polymerization initiator | Hardening condition |
|---|---|---|---|
| Example 1 | 0.0055 | Polymerization initiator 1-5 | Light |
| Comparative Example 1 | — | Polymerization initiator 1-5 | Light |
| Comparative Example 2 | 0.0044 | Polymerization initiator 1-5 | Light |
| Comparative Example 3 | — | Polymerization initiator 1-5 | Light |
| Comparative Example 4 | 0.0055 | Polymerization initiator 1-5 | Light |
| Comparative Example 5 | — | Polymerization initiator 1-5 | Light |
| Example 2 | 0.0063 | Polymerization initiator 1-5 | Light |
| Comparative Example 6 | — | Polymerization initiator 1-5 | Light |
| Comparative Example 7 | 0.0045 | Polymerization initiator 1-5 | Light |
| Comparative Example 8 | — | Polymerization initiator 1-5 | Light |
| Comparative Example 9 | 0.0063 | Polymerization initiator 1-5 | Light |
| Comparative Example 10 | — | Polymerization initiator 1-5 | Light |
| Example 3 | 0.0060 | Polymerization initiator 1-5 | Light |
| Example 4 | 0.0055 | Polymerization initiator 1-5 | Light |
| Example 5 | 0.0055 | Polymerization initiator 1-5 | Light |
| Example 6 | 0.0055 | Polymerization initiator 1-5 | Light |
| Example 7 | 0.0086 | Polymerization initiator 1-5 | Light |
| Example 8 | 0.0091 | Polymerization initiator 1-5 | Light |
| Example 9 | 0.0098 | Polymerization initiator 5-1 | Heat |

Ac/M is methacryloyl function group density which is defined a ratio of a number of the methacryloyl groups Ac to a molecular weight M of the polymerizable compound having a methacryloyl group.

Hardenable monomers 36 and 37 used in the photoreceptors 3 and 9 are shown below.

Compound (36)

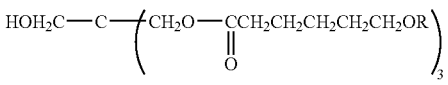

Compound (37)

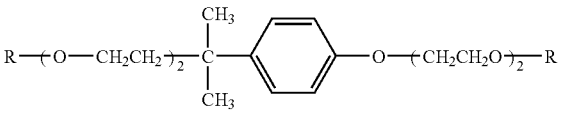

In the formulae

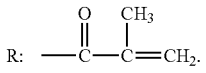

Evaluation of the Photoreceptors

Measurement of Abrasion Amount of Protective Layer

The photoreceptor was mounted on image forming apparatus "bizhub C352" (produced by Konica Minolta Business Technologies Inc.). Abrasion was evaluated by measuring reduction of layer thickness by a durability test in which 50,000 sheets printing of A4 paper of a full color image having a black ratio of 5% was successively carried out at normal condition of 20° C., 50% RH. The thickness was measured via employing FISCHERSCOPE® marketed by Fischer Instruments K.K. Wastage thickness in μm for 100,000 rotation of the photoreceptor was observed.

Non-Uniform Abrasion by Durability Test

A half tone image was printed out after 50,000 sheets durability test, and non-uniform abrasion of the protective layer observed on the printed image was evaluated.

Criteria

A: White streaks are scarcely observed.

B: White streaks are thinly observed.

C: White streaks are observed on a whole image.

Evaluation of Image Blur

Printing test was conducted by employing the apparatus "bizhub PRO C352" in the printing environment was changed at 38° C. and 80% RH, and prints was made on 5,000 sheets of A4 size full color image, and the apparatus was allowed to stand over night. A half tone image was printed out, and image blur just under a charge electrode was evaluated.

Criteria of Image Blur

A: No blur was observed in half tone image and normal.

B: Thin density depression at just under a charge electrode was observed in half tone image.

C: Density depression at just under a charge electrode was observed.

The result is summarized in the Table 2.

TABLE 2

| No. | Photo-receptor No. | Wasted thickness (μm)/100,000 rotation | Non-uniform abrasion | Image blur |
|---|---|---|---|---|
| Example 1 | 1 | 0.03 | A | A |
| Comparative Example 1 | 2 | 0.025 | A | C |
| Comparative Example 2 | 3 | 0.25 | C | B |
| Comparative Example 3 | 4 | 0.2 | C | C |
| Comparative Example 4 | 5 | 0.53 | C | A |
| Comparative Example 5 | 6 | 0.08 | A | C |
| Example 2 | 7 | 0.03 | A | A |
| Comparative Example 6 | 8 | 0.03 | A | C |
| Comparative Example 7 | 9 | 0.25 | C | B |
| Comparative Example 8 | 10 | 0.2 | C | C |
| Comparative Example 9 | 11 | 0.44 | C | A |
| Comparative Example 10 | 12 | 0.07 | A | C |
| Example 3 | 13 | 0.03 | A | A |
| Example 4 | 14 | 0.02 | A | A |
| Example 5 | 15 | 0.03 | A | A |
| Example 6 | 16 | 0.04 | A | A |
| Example 7 | 17 | 0.025 | A | A |
| Example 8 | 18 | 0.03 | A | A |
| Example 9 | 19 | 0.05 | B | A |

The photoreceptors according to this invention are evaluated as good in each evaluation item. Comparative photoreceptors 28-32 are evaluated as practically not acceptable in at least one item.

What is claimed is:

1. A photoreceptor comprising a photosensitive layer, provided on an electric conductive support, and a protective layer, wherein the protective layer comprises a composition obtained by reacting tin oxide particles having an acryloyl or methacryloyl group on their surface with a polymerizable compound having a methacryloyl group, Ac/M being not less than 0.005, wherein Ac is a number of the methacryloyl groups of the polymerizable compound and M is a molecular weight of the polymerizable compound having a methacryloyl group, wherein the tin oxide particles having an acryloyl or methacryloyl group on their surface are produced by surface treating tin oxide particles with a compound having an acryloyl or methacryloyl group, and the compound having an acryloyl or methacryloyl group is represented by the Formula (1), Formula (1)

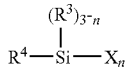

wherein $R^3$ is an alkyl group having carbon atoms of from 1 to 10 or an aralkyl group having carbon atoms from 6 to 10, $R^4$ is an organic group having a reactive acryloyl or methacryloyl group, X is a halogen atom or an alkoxy group, and n is an integer of from 1 to 3.

2. The photoreceptor of claim 1, wherein $R^3$ is a methyl or ethyl group.

3. The photoreceptor of claim 1, wherein the protective layer is formed by photo-polymerization or thermal-polymerization of the tin oxide particles having an acryloyl or methacryloyl group with the polymerizable compound having a methacryloyl group.

4. The photoreceptor of claim 1, wherein Ac/M is not less than 0.005 and not more than 0.05.

5. An image forming apparatus comprising a charging unit, an imagewise exposing unit and a developing unit arranged around the photoreceptor of claim 1.

6. A manufacturing method of a photoreceptor comprising a photosensitive layer, provided on an electric conductive support, and a protective layer, the method comprises steps of;

forming the photosensitive layer on the electric conductive support, and forming the protective layer thereon, wherein the protective layer is formed by reacting tin oxide particles having an acryloyl or methacryloyl group on their surfaces and are produced by surface treating the tin oxide particles with a silane compound represented by Formula (1)

with a polymerizable compound having a methacryloyl group, Ac/M ratio being not more less 0.005, wherein Ac is a number of the methacryloyl groups and M is a molecular weight of the polymerizable compound having a methacryloyl group, Formula (1)

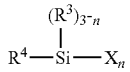

wherein $R^3$ is an alkyl having carbon atoms from 1 to 10 or an aralkyl having carbon atoms of from 6 to 10, $R^4$ is an organic group having a reactive acryloyl or methacryloyl group, X is a halogen atom or an alkoxy, and n is an integer of from 1 to 3.

7. A manufacturing method of claim 6, wherein a number average particle diameter of the tin oxide particles is 1-300 nm.

8. A manufacturing method of a photoreceptor comprising a photosensitive layer, provided on an electric conductive support, and a protective layer, the method comprises steps of forming the photosensitive layer on the support, and forming the protective layer thereon, wherein the protective layer is formed by steps of;

applying a protective layer coating composition comprising a tin oxide particles having an acryloyl or methacryloyl group on their surface, and a polymerizable compound having a methacryloyl group and Ac/M being not less than 0.005, wherein Ac is a number of the methacryloyl groups and M is a molecular weight of the polymerizable compound having a methacryloyl group, and exposing actinic ray to or heating the coated composition to react the tin oxide particles having the acryloyl or methacryloyl group on their surface with the polymerizable compound having a methacryloyl group, wherein the tin oxide particles having an acryloyl or methacryloyl group on their surface are produced surface treating tin oxide particles with a compound having an acryloyl or methacryloyl group, and the compound having an acryloyl or methacryloyl group is represented by Formula (1), Formula (1)

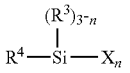

wherein $R^3$ is an alkyl croup having carbon atoms of from 1 to 10 or an aralkyl group having carbon atoms from 6 to 10, $R^4$ is an organic group having a reactive acryloyl or methacryloyl group, X is a halogen atom or an alkoxy group, and n is an integer of from 1 to 3.

* * * * *